United States Patent [19]

Strohmeyer

[11] Patent Number: 5,020,733

[45] Date of Patent: Jun. 4, 1991

[54] DOCUMENT SHREDDER WITH ONE OR MORE TRAYS FOR STACKS OF PAPER IN CONTINUOUS FORM

[75] Inventor: Willi Strohmeyer, Hanover, Fed. Rep. of Germany

[73] Assignee: Geha-Werke GmbH, Hanover, Fed. Rep. of Germany

[21] Appl. No.: 509,742

[22] Filed: Apr. 17, 1990

Related U.S. Application Data

[63] Continuation of Ser. No. 323,918, Mar. 15, 1989.

[30] Foreign Application Priority Data

Mar. 15, 1988 [DE] Fed. Rep. of Germany ..... 3808486

[51] Int. Cl.[5] ..... B02C 18/22

[52] U.S. Cl. ..... 241/100; 241/242; 241/235

[58] Field of Search ..... 241/242, 243, 235, 236, 241/100

[56] References Cited

U.S. PATENT DOCUMENTS

| | | | |
|---|---|---|---|
| 4,226,372 | 10/1980 | Wigand | 241/34 |
| 4,565,330 | 1/1986 | Katoh | 241/236 |
| 4,815,669 | 3/1989 | Fujii | 241/236 X |
| 4,817,877 | 4/1989 | Itoh et al. | 241/236 X |
| 4,821,967 | 4/1989 | Moriyama | 241/236 X |

FOREIGN PATENT DOCUMENTS

| | | |
|---|---|---|
| 2641370 | 3/1978 | Fed. Rep. of Germany . |
| 2717522 | 10/1978 | Fed. Rep. of Germany . |
| 3112835 | 1/1983 | Fed. Rep. of Germany . |
| 2095579 | 10/1982 | United Kingdom . |

*Primary Examiner*—Timothy V. Eley
*Attorney, Agent, or Firm*—Foley & Lardner

[57] ABSTRACT

The invention is characterized in that at least one tray for the stack(s) of paper is arranged on the top of the document shredder. As a result, the document shredder requires a smaller installation area. Futhermore, the stability of the document shredder is improved. Since the stacks of paper are positioned at working height, the document shredder is extremely convenient to operate. The design according to the invention also allows a cost saving.

4 Claims, 3 Drawing Sheets

DOCUMENT SHREDDER WITH ONE OR MORE TRAYS FOR STACKS OF PAPER IN CONTINUOUS FORM

This application is a continuation of application Ser. No. 07/323,918, filed Mar. 15, 1989.

BACKGROUND OF THE INVENTION

The invention relates to a document shredder with one or more trays for stack(s) of paper in continuous form, in particular for electronic data processing (EDP) listings in fanfold form.

Wherever stack(s) of paper in continuous form, for example EDP listings in fanfold form, are to be destroyed in document shredders, it is known to arrange one or more trays for the stacks of paper at the side of the cupboard-like lower structure of these devices (German Offenlegungsschrift 3,606,311). Assuming the beginning of the stack of paper is introduced into the infeed duct of the document shredder, the entire continuous listing is generally drawn in by the cutting mechanism and shredded. Considerable quantities of paper can be shredded in this way without great effort on the part of the operator. Assuming that the beginnings of several stacks of paper are introduced into the infeed duct of the document shredder, it is also possible to shred the paper of several stacks simultaneously.

However, with the known solutions it is disadvantageous that the trays arranged either on the front side or on the rear side of the cupboard-like lower structure of the document shredders increase the necessary installation space for the shredder. For example, whenever the trays are arranged on the rear side of the cupboard-like lower structure, the document shredder cannot be positioned with its rear side directly against a wall. On the other hand, the arrangement of the trays on the front side of the cupboard-like lower structure is problematical as there is generally then a door which must swing open sideways to make possible the removal of the waste bag arranged in the cupboard-like lower structure. Added to this is the fact that, with a side arrangement of the trays, whenever relatively large quantities of paper are placed upon them, an adverse displacement of the center of gravity may occur. Consequently there is an increased danger of the document shredder tipping over, which is impermissible for reasons of equipment safety. Furthermore, the side arrangement of the trays on the cupboard-like lower structure of the document shredder is also not an optimal solution from the operator's viewpoint, since accessibility is impaired and the loading of the lower trays requires the operator to adopt a bent posture.

There presently exists a need for a document shredder which will eliminate many of the disadvantages associated with the devices now available.

OBJECTS OF THE INVENTION

It is therefore an object of the present invention to provide a document shredder in which the tray or trays for the stack(s) of paper are arranged on top of the document shredder.

It is a further object to provide a document shredder which does not have any greater space requirement than those devices already known in the art.

Another object of the present invention is to provide a document shredder in which the tilting moment of the device is not increased to the extent which occurs when the stack(s) of paper are arranged on the side of a conventional shredder.

Still another object is to provide a document shredder whose cupboard is easily accessible.

A further object of the invention is to provide a document shredder whose working surface is easily accessible to the average individual.

Another object is to provide a document shredder which is less expensive since the stability problems associated with the design of the paper trays will be smaller than in conventional shredders.

SUMMARY OF THE INVENTION

These and other objects are achieved according to the invention by providing a document shredder with at least one tray for holding at least one stack of paper in continuous form, wherein said tray for said stack of paper is arranged on the top of said document shredder. Further development of the invention is to be taken from the subclaims.

DETAILED DESCRIPTION OF THE PREFERRED EMBODIMENTS

Figure 1:
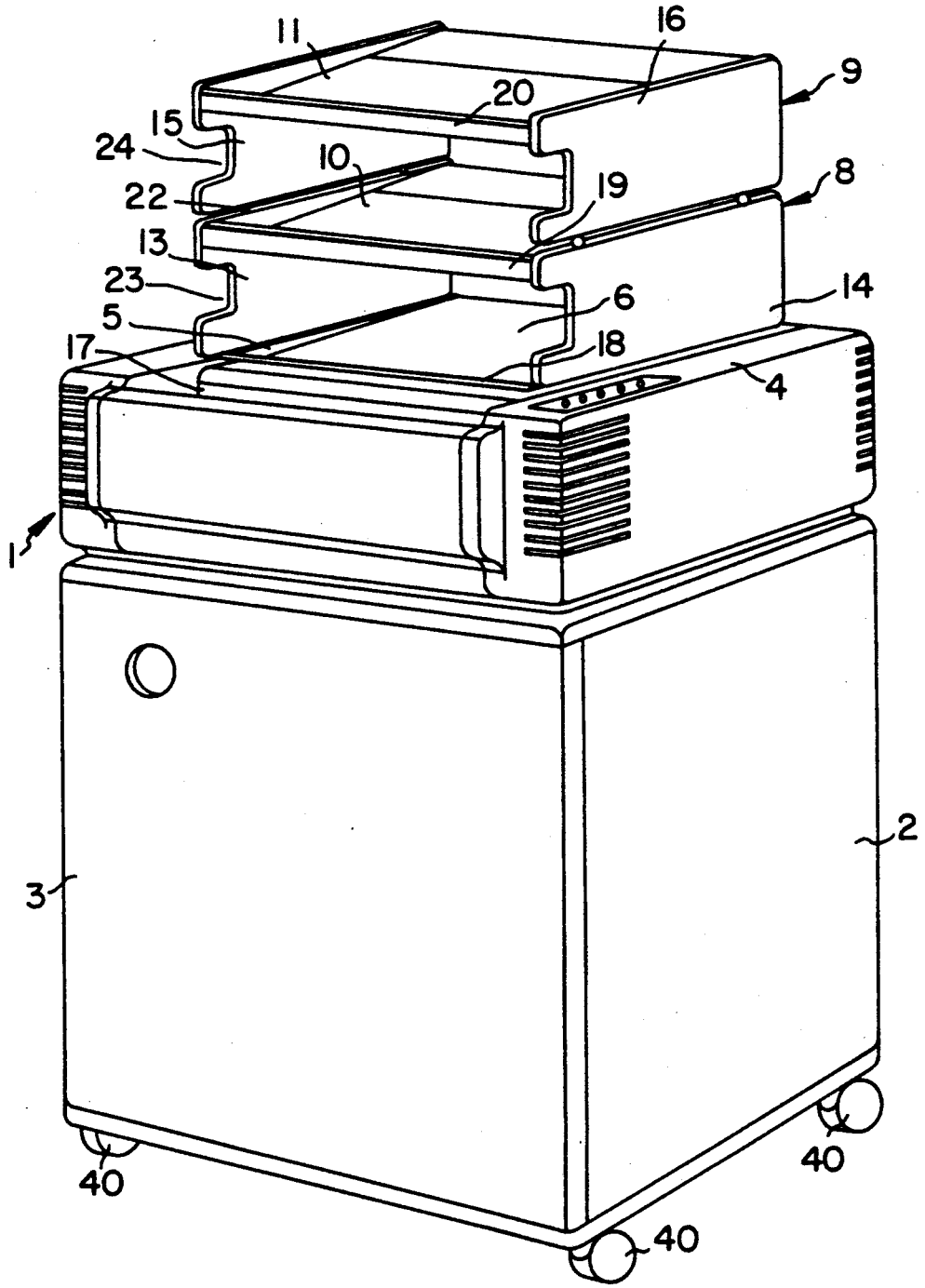
FIG. 1 illustrates a document shredder with trays arranged on top of it.

Referring to FIG. 1, a document shredder 1 is arranged on a cupboard-like lower structure 2. The cupboard-like lower structure 2 has on its front side a door 3, which can swing open and must be opened when changing a waste bag (not shown) arranged inside the cupboard-like lower structure 2. Arranged underneath the cupboard-like lower structure 2 are rollers 40, which make it possible for the document shredder 1 to be mobile.

On its top 4, the document shredder 1 has a recess 5, which can form a tray 6 for positioning a stack of paper. Also arranged on the top 4 of the document shredder 1 are attachments 8 and 9, which have a further tray 10 and 11, respectively, for stack(s) of paper.

Figure 2:
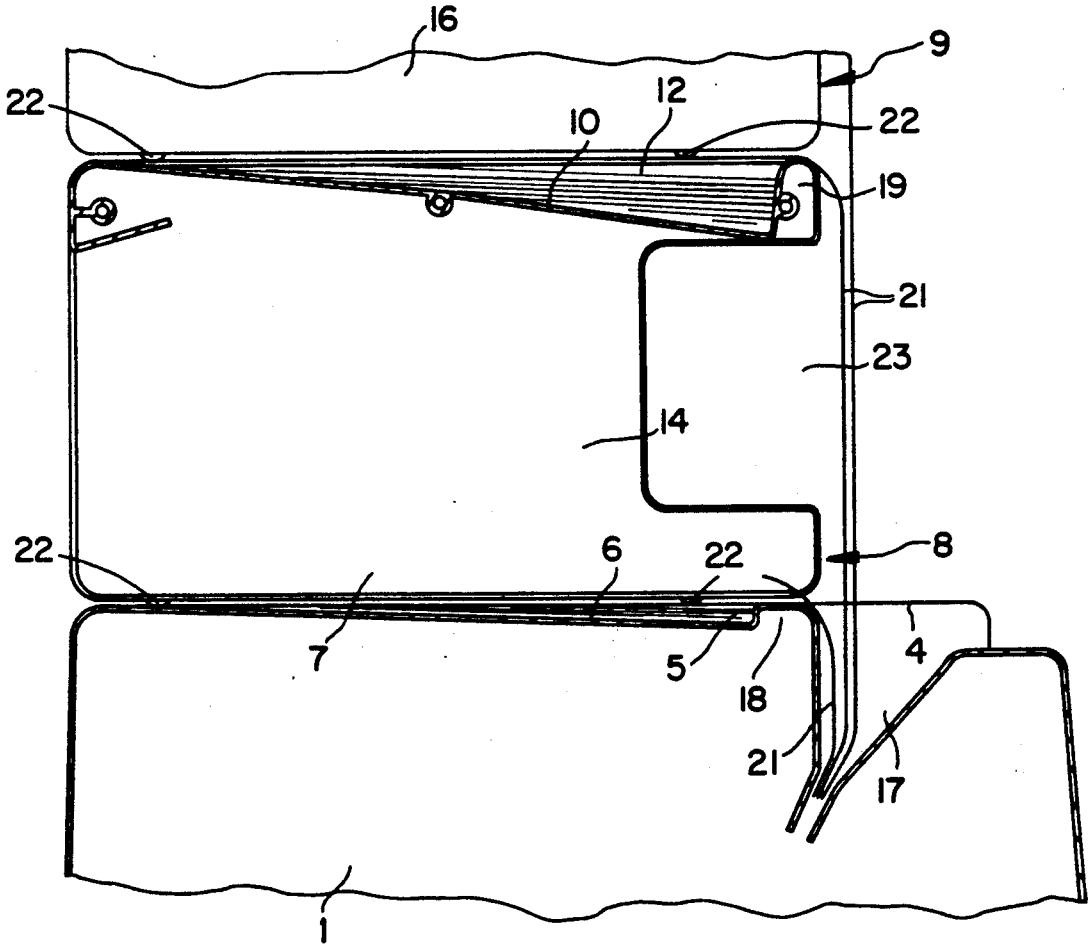
FIG. 2 illustrates a cross-section of the trays of the document shredder shown in FIG. 1.

Referring also to FIG. 2, the stack of paper placed on the tray 10 is denoted by 12. The trays 10 and 11 of the attachments 8 and 9 are fastened in side parts 13 and 14 and 15 and 16, respectively. The trays 6, 10 and 11 are arranged sloping towards the front, i.e. in the direction of an infeed duct 17 of the document shredder 1. On the side facing the infeed duct 17 of the document shredder 1, the trays 6, 10 and 11 each have a stop 18, 19, 20, respectively, for the stacks of paper 7 and 12. From the stacks of paper 7 and 12 (illustrated only in FIG. 2), as well as from the stack of paper on the tray 11 (illustrated only in FIG. 1), the paper 21 is guided via the stops 18, 19, 20 into the infeed duct 17. The attachments 8 and 9 have on the lower and upper edges of their side parts 13, 14, and 15, 16 a means 22, for example pins, which engage in the top 4 of the document shredder or in the underlying side parts 13, 14. The means 22 serves to fasten the attachments 8 and 9 onto the document shredder 1.

Due to the arrangement of a stop 18, 19 and 20 on the side of the trays 5, 10 and 11 facing the infeed duct 17, it is ensured that the stack of paper is withdrawn sheet by sheet over the stops 18, 19 and 20. Due to the horizontal or downwardly directed withdrawal direction of the paper 21, without the stops 18, 19 and 20 there would be an uncontrolled multiple-sheet withdrawal of the paper 21. The sloping arrangement of the trays 6, 10 and 11 advantageously assists the satisfactory withdrawal function.

For better accessibility of the trays 10 and 11, the side parts 13, 14, and 15, 16 of the attachments 8 and 9 are preferably provided on their front side with recesses 23 and 24. These recesses 23 and 24 facilitate not only the loading of the stacks of paper 7 and 12, but also facilitate the gripping of the beginning sheet of the paper 21, which is then withdrawn manually from the stack and inserted into the infeed duct 17. As soon as the cutting mechanism (not shown) of the document shredder 1 grips the beginning sheet of paper 21, the entire paper 21 comprising the stacks of paper 7 and 12 is automatically drawn into the cutting mechanism sheet by sheet and shredded. Since the paper of several stacks of paper 7 and 12 can be introduced simultaneously into the infeed duct 17, i.e. into the cutting mechanism in each case, it is possible to shred considerable quantities of paper with little additional physical effort on the part of the operator.

According to the invention, it is of course not absolutely necessary to arrange the attachments 8 and 9 on the top 4 of the document shredder 1. Provided that a recess 5 with a tray 6 according to the invention is provided on the top 4 of the document shredder 1, a stack of paper 7 can be placed there, the paper of which can be introduced into the infeed duct 17, i.e. into the cutting mechanism. Whenever the quantities of paper to be destroyed are relatively small, this embodiment of the invention can be quite advantageous in practice. For example, the advantages mentioned under the Objects, such as space saving and a stable center of gravity, can be fully realized. Furthermore, in this case not a single additional part is necessary, so that this embodiment is particularly inexpensive. Whenever relatively large quantities of paper have to be destroyed, one, two or even more attachments 8 and 9 can be arranged on the document shredder 1.

Figure 3:
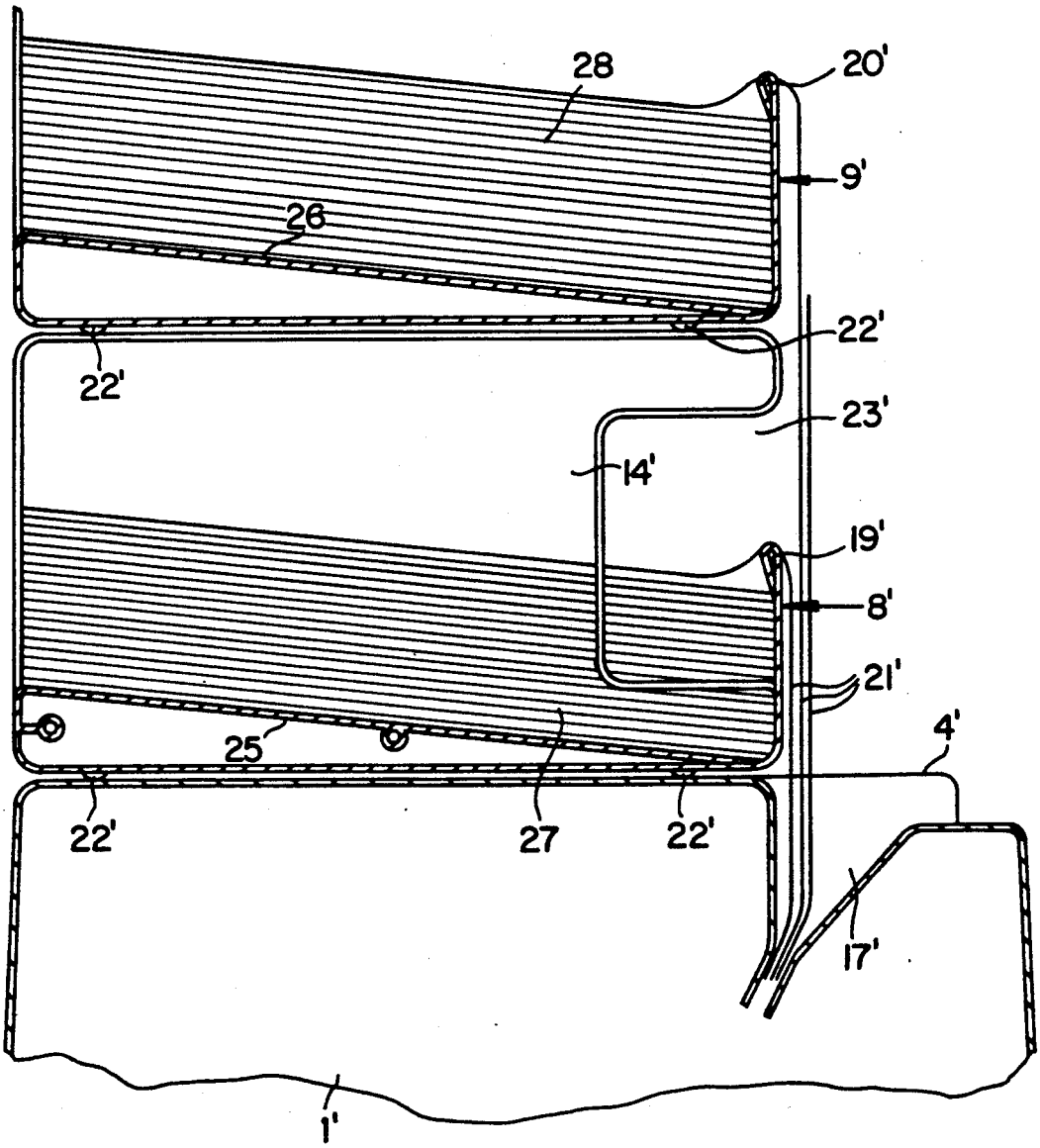
FIG. 3 illustrates another embodiment of the trays in cross-section.

Referring now to FIG. 3, whenever no recess, i.e. no tray, is provided on the top 4' of document shredder 1', the invention can nevertheless be embodied in the form wherein attachments 8' and 9' are arranged. The attachments 8' and 9' are essentially designed identically to the attachments 8 and 9 illustrated in FIG. 1. However, in FIG. 3 the trays 25 and 26 are advantageously fastened in the lower or bottom region of the side parts 13', 14', and 15', 16'. Otherwise, the space available between the side parts could not be used optimally for the arrangement of the stacks of paper 27 and 28. As can be seen from FIGS. 2 and 3, the trays are all arranged above the infeed duct, and each tray slopes at a fixed angle downwardly toward the infeed duct. Also, each stop is contiguous to the sloping tray with which it is associated.

The foregoing description has been set forth merely to describe illustrative embodiments of the invention and is not intended to be limiting. Since modifications of the described embodiments incorporating the spirit and substance of the invention may occur to persons skilled in the art, the scope of the invention should be limited solely with respect to the appended claims and equivalents.

What is claimed is:

1. A document shredder with at least one tray for holding at least one stack of paper in continuous form, wherein said document shredder contains an infeed duct, said tray is arranged above said infeed duct and is provided with a contiguous stop on the side facing said infeed duct of said shredder, and said tray for said stack of paper is arranged on the top of said document shredder so as to slope at a fixed angle downwardly towards said contiguous stop.

2. A document shredder as claimed in claim 1, wherein the top of said shredder is provided with a recess which forms a tray for a stack of paper, said recess containing a stop on the side facing said infeed duct of said shredder, and said tray formed by said recess sloping toward said stop.

3. A document shredder as claimed in claim 1, wherein at least one tray for a stack of paper is attached to the top of said document shredder, each attached tray having a stop on the side facing said infeed duct and being arranged to slope toward said stop.

4. In combination, a document shredder comprising a cabinet with an infeed duct for paper to be shredded, at least one tray arranged on top of said cabinet having a tray bottom which slopes downwardly at a fixed angle towards said infeed duct, each said tray being provided with a stop contiguous to said tray bottom on the side of said tray facing said infeed duct for preventing paper from sliding off said sloping tray bottom into said infeed duct, and a stack of continuous paper disposed on said sloping tray, one end of said continuous paper being drawn from atop said stack over said stop and down through said infeed duct, whereby the slope of said tray facilitates unfolding of said continuous paper as it is drawn from atop said stack toward said infeed duct.

* * * * *